US006511289B2

(12) United States Patent
Yu

(10) Patent No.: US 6,511,289 B2
(45) Date of Patent: Jan. 28, 2003

(54) SIDE EXHAUST FAN STRUCTURE

(76) Inventor: Chung Che Yu, 5F-23, 70, Fu-Shing Road, Taoyuan (TW)

( * ) Notice: Subject to any disclaimer, the term of this patent is extended or adjusted under 35 U.S.C. 154(b) by 0 days.

(21) Appl. No.: 09/836,188

(22) Filed: Apr. 18, 2001

(65) Prior Publication Data

US 2002/0154994 A1 Oct. 24, 2002

(51) Int. Cl.[7] ..... F04D 29/54
(52) U.S. Cl. ..... 415/206; 416/234
(58) Field of Search ..... 415/206; 416/179, 416/182, 185, 202, 234

(56) References Cited

U.S. PATENT DOCUMENTS 927,319 A * 7/1909 Bemiller ..... 415/206
1,649,161 A * 11/1927 Foster ..... 415/206 X
2,332,411 A * 10/1943 Swanson et al. ..... 416/202 X

FOREIGN PATENT DOCUMENTS

GB 134701 * 11/1919 ..... 416/202

* cited by examiner

*Primary Examiner*—Edward K. Look
*Assistant Examiner*—Dwayne J. White
(74) *Attorney, Agent, or Firm*—Troxell Law Office PLLC

(57) ABSTRACT

A modified side exhaust fan structure with multiple flush and rectangular blades in whirling arrangement provided in a guide frame having side exhaust topped by a hood. Each blade indicates upright to the plane of the hood. Air current created as the fan turns is fully drained crossing the vertical plane of each blade offering an effective solution to the problem of insufficient air drain due to back-draft found in the prior art with blades each with an exit inclination.

1 Claim, 4 Drawing Sheets

SIDE EXHAUST FAN STRUCTURE

BACKGROUND OF THE INVENTION a) Field of the Invention

The present invention relates to a structure of fan with side exhaust, and more particularly, to one that air current generated as the fan turns can be forthwith drained at an amount equal to that of suction to yield more significant cooling effect.

(b) Description of the Prior Art

A fan with side exhaust, compact and quiet, generally available in the market is very popular. As illustrated in FIGS. 1 and 2 of the accompanying drawings, a fan 3 of the prior art is essentially comprised of multiple blades 31' each having a certain inclination. As the fan 3' turns, air is fed into the fan 3' through a suction provided on a casing of the fan 3'. Airflow is created as the fan 3 turns and exits out of the side exhaust. However, certain portion of the leaving airflow as guided by the exit blade inclination will be drained from the suction. As a result, the suction is always greater than the drain to frustrate the efficiency of the fan 3'.

SUMMARY OF THE INVENTION

The purpose of the present invention is to provide a modified structure of fan with side exhaust. Within, blades are arrangement in a whirling pattern with each in the form of a flush and rectangular plate vertically disposed, so that the air current generated as the fan turns can be completely drained crossing the plane of each blade to yield 100% drainage.

DETAILED DESCRIPTION OF THE PREFERRED EMBODIMENTS

Figure 1:
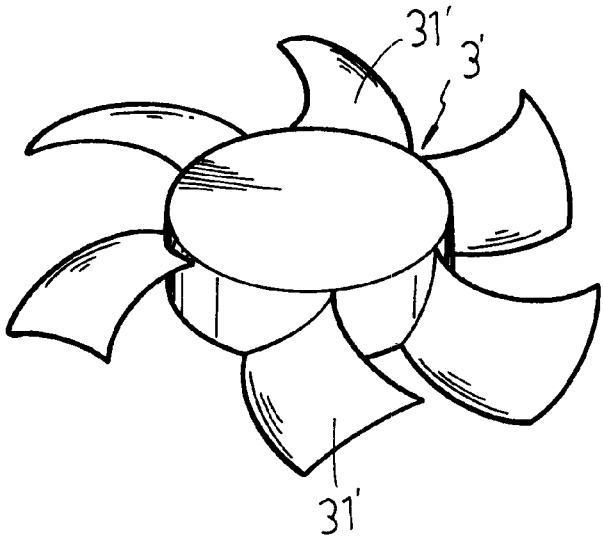
Prior Art FIG.1
FIG. 1 is a view showing the appearance of a fan blade of the prior art.
Figure 2:
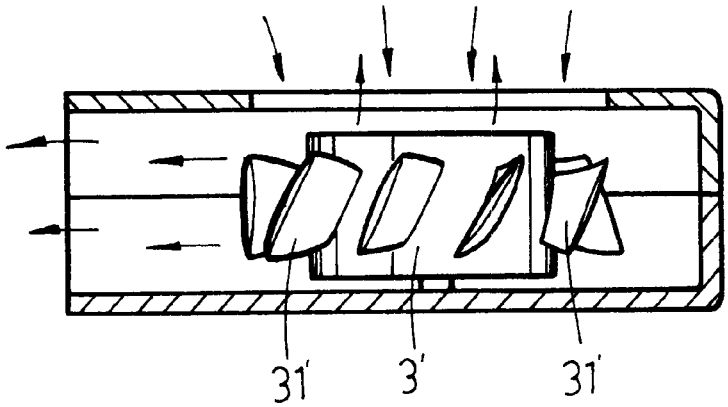
Prior Art FIG.2
FIG. 2 is a schematic view showing the operation of a fan of the prior art.
Figure 3:
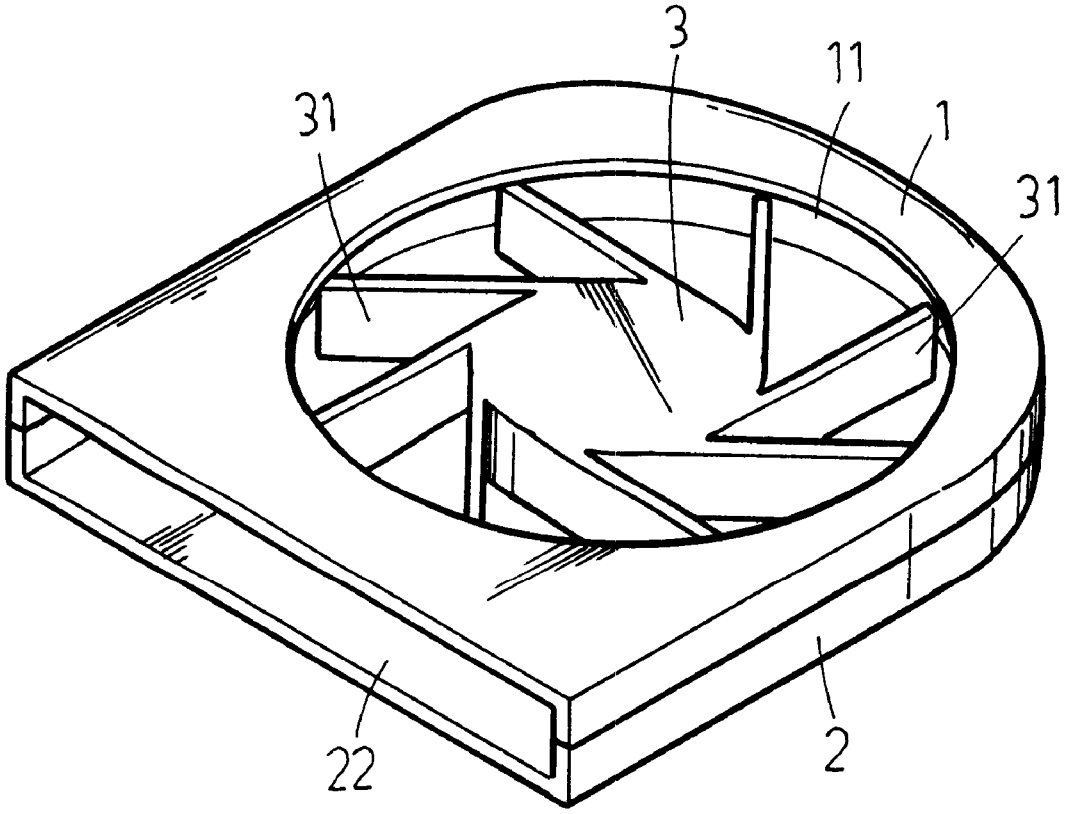
FIG. 3 is a view showing the appearance of the present invention.
Figure 4:
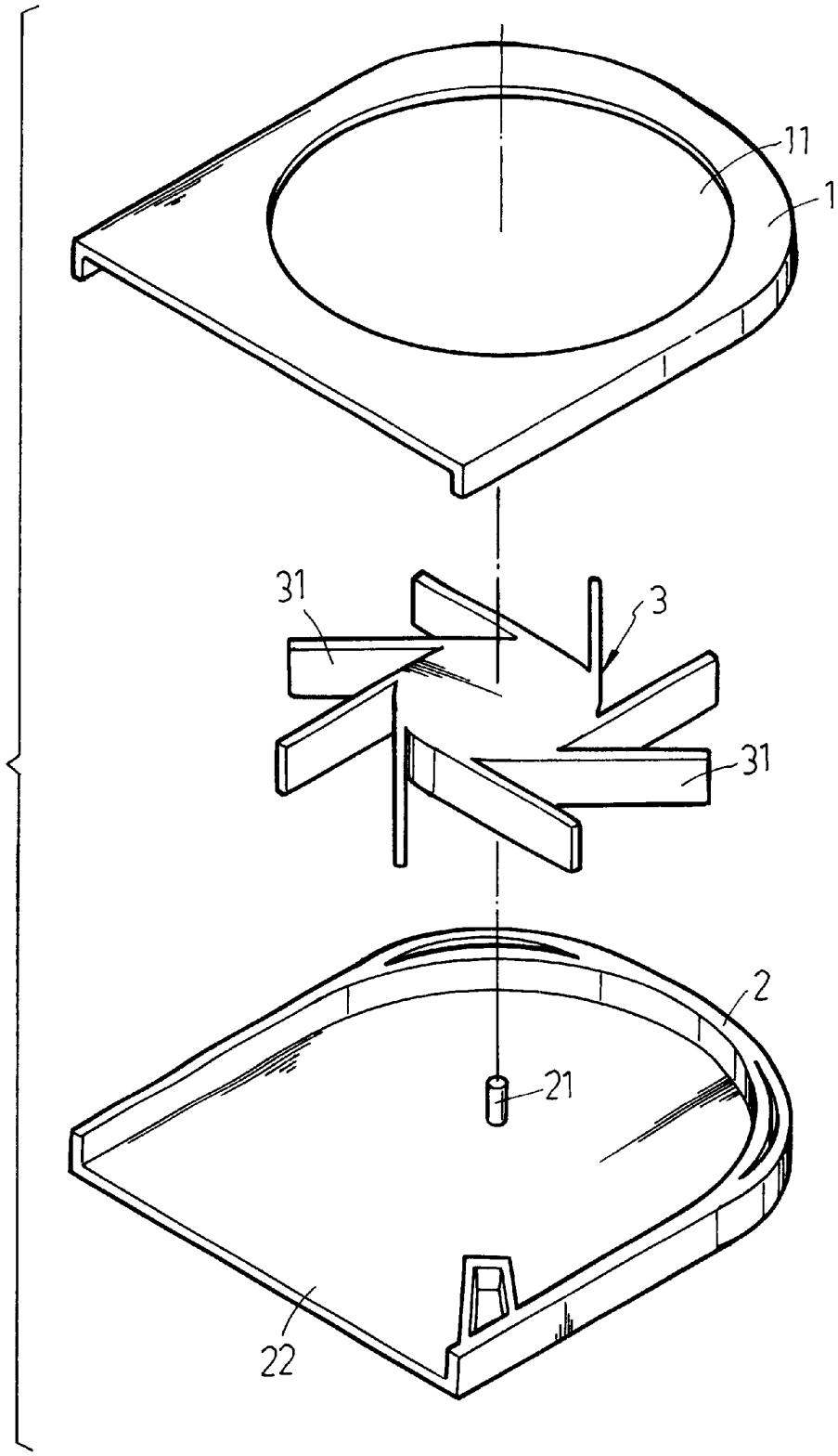
FIG. 4 is an exploded view of a preferred embodiment of the present invention.
Figure 5:
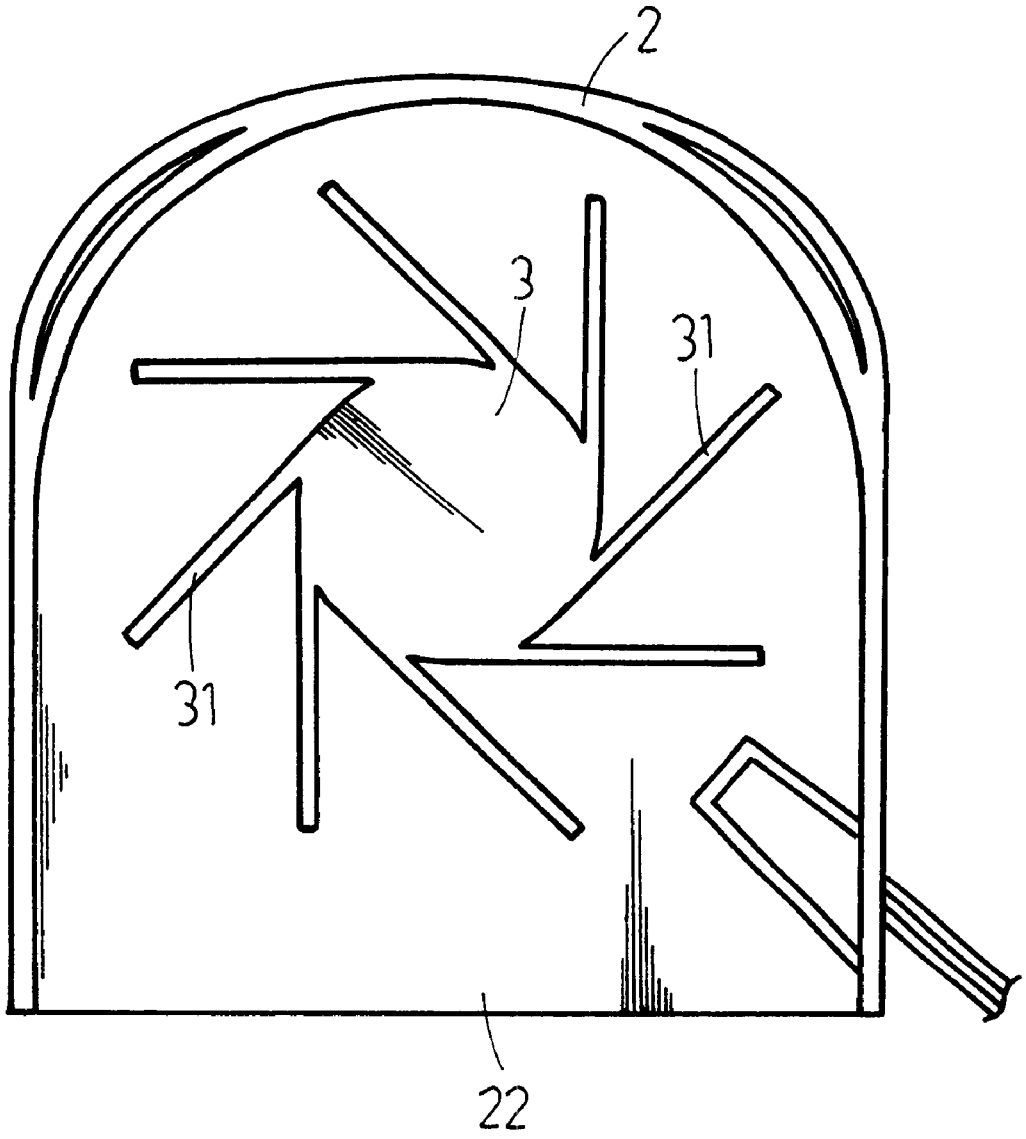
FIG. 5 is a top view of the preferred embodiment of the present invention.

Referring to FIGS. 3, 4 and 5, a preferred embodiment of the present invention is comprised of a hood 1, a guide frame 2 and a fan 3. Within, a suction 11 is provided on the hood 1 and a side exhaust 22 on the guide frame 2. Said fan is disposed at a shaft 21. As the fan 3 turns, the suction 11 introduces in the air which exits from the side exhaust 22.

Said fan 3 is comprised of multiple blades 31 arranged in a whirling pattern and vertically to the plane of the hood 1. Each blade 31 indicates a flush and rectangular plate. As the blade 31 turns, the air current flows crossing the plane of the blade 31 and easily exits from the drain 22 to achieve substantially one hundred percent air convection without loss from the back-draft to the suction 11 as found with the prior art having blades with certain inclination.

The modified structure of the fan with side exhaust disclosed above will achieve its expected purpose and result. The present invention has not yet been published nor used in public as of this date of application. It meets elements of being innovative and advanced as required by a utility patent. Therefore, this application for utility patent is duly filed.

However, specification and accompanying drawings disclosed herein relate only to a preferred embodiment of the present invention. Any equivalent modification or variation based on the spirit of the present invention by those who are familiar with this art shall be deemed falling within the scope as claimed by this application.

What the invention claimed is:

1. A fluid fan comprising: a housing with a fluid inlet and a fluid outlet, and a fan, the fan having a plurality of blades; each blade having a rectangular shape and having a longitudinal axis, the longitudinal axis of the blades being offset from a rotational axis of the fan; the fluid inlet being substantially center along the rotational axis of the fan; and the fan outlet being located on a side of the housing, the outlet having a height substantially the same as the fan height and a width substantially equal to the fan width.

* * * * *